US006447036B1

(12) United States Patent
White

(10) Patent No.: US 6,447,036 B1
(45) Date of Patent: Sep. 10, 2002

(54) PILE CLAMP SYSTEMS AND METHODS

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 09/534,918

(22) Filed: Mar. 23, 2000

Related U.S. Application Data

(60) Provisional application No. 60/125,930, filed on Mar. 23, 1999.

(51) Int. Cl.[7] ..... B66C 1/44; E02D 7/18

(52) U.S. Cl. ..... 294/113; 294/88; 294/106; 405/232

(58) Field of Search ..... 294/86.29, 86.4, 294/104, 106, 88, 102.2, 113, 114, 902, 103.1; 405/228, 231, 232

(56) References Cited

U.S. PATENT DOCUMENTS

| | | | |
|---|---|---|---|
| 628,962 A | 7/1899 | Speer | |
| 1,288,989 A | 12/1918 | Rees | |
| 1,322,470 A | 11/1919 | Schenk | |

(List continued on next page.)

FOREIGN PATENT DOCUMENTS

| | | | |
|---|---|---|---|
| EP | 0172960 A1 | 3/1986 | |
| EP | 362158 A | 9/1988 | |
| EP | 0526743 B1 | 8/1995 | |
| FR | 838717 | 3/1939 | |
| FR | 2560247 | 2/1984 | |
| GB | 2003769 A | 8/1978 | |
| GB | 2023496 A | 1/1980 | |
| GB | 2028902 B | 8/1982 | |
| JP | 246681 * | 9/1993 | ..... 294/113 |
| KR | 92-16944 | 9/1992 | |
| NL | 42349 | 1/1938 | |
| NL | 65252 | 1/1950 | |
| NL | 7707303 | 7/1977 | |
| NL | 7710385 | 9/1977 | |
| NL | 7805153 | 5/1978 | |
| RU | 1027357 | 7/1983 | |
| WO | WO87/07673 | 12/1987 | |
| WO | WO88/05843 | 8/1988 | |

OTHER PUBLICATIONS

A series of photographs identified by Ref. Nos APE01147 through APE01159 (Undated).

Japanese language brochure entitled Castle Board Drain Method:, (Aug. 1976), Ref. Nos. APE00857–00863.

"The 1st Report on the Treatment of Soft Foundation of Juck Hyun Industrial Site" (Ref. Nos. APE00854 through APE00856).

Schematic drawings identified by Ref. Nos. APE01038, APE01039, and APE0339 (Undated).

(List continued on next page.)

*Primary Examiner*—Johnny D. Cherry
(74) *Attorney, Agent, or Firm*—Michael R. Schacht; Schacht Law Office, Inc.

(57) ABSTRACT

A clamp assembly for attaching a pile to a pile driving apparatus for inserting and/or extracting the pile, comprising a housing; a first pivot assembly pivotably attached to the housing; a first gripping assembly rotatably attached to the first pivot assembly; a second pivot assembly pivotably attached to the housing; a second gripping assembly rotatably attached to the second pivot assembly; a first actuating assembly for displacing the first pivot assembly and the first gripping assembly such that first gripping assembly moves towards the second gripping assembly; and a second actuating assembly for displacing the second pivot assembly and the second gripping assembly such that second gripping assembly moves towards the first gripping assembly; wherein as the first and second gripping assemblies move towards each other, the pile is gripped between the first and second gripping assemblies to inhibit relative movement between the housing and the pile.

10 Claims, 7 Drawing Sheets

U.S. PATENT DOCUMENTS

| | | | | | |
|---|---|---|---|---|---|
| 1,654,093 | A | | 12/1927 | Reid | |
| 1,702,349 | A | * | 2/1929 | Krell | 294/113 |
| 1,762,037 | A | * | 6/1930 | Taylor | 294/113 X |
| 1,903,555 | A | | 4/1933 | Robertson | |
| 2,577,252 | A | | 12/1951 | Kjellman | |
| 2,952,132 | A | | 9/1960 | Urban | |
| 3,149,851 | A | | 9/1964 | Adams | |
| 3,172,485 | A | | 3/1965 | Spannhake et al. | |
| 3,177,029 | A | * | 4/1965 | Larson | 294/88 |
| 3,243,190 | A | | 3/1966 | Peregrine | |
| 3,300,987 | A | | 1/1967 | Maeda | |
| 3,313,376 | A | | 4/1967 | Holland, Sr. | |
| 3,391,435 | A | | 7/1968 | Lebelle | |
| 3,684,037 | A | | 8/1972 | Bodine | |
| 3,711,161 | A | | 1/1973 | Proctor et al. | |
| 3,720,435 | A | * | 3/1973 | Leyn | 294/113 X |
| 3,828,864 | A | | 8/1974 | Haverkamp et al. | |
| 3,871,617 | A | | 3/1975 | Majima | |
| 3,874,244 | A | | 4/1975 | Rasmussen et al. | |
| 3,891,186 | A | | 6/1975 | Thorsell | |
| 3,907,042 | A | | 9/1975 | Halwas et al. | |
| 3,998,063 | A | * | 12/1976 | Harders | 294/103.1 X |
| 4,018,290 | A | | 4/1977 | Schmidt | |
| 4,082,361 | A | | 4/1978 | Lanfermann | |
| 4,099,387 | A | | 7/1978 | Frederick et al. | |
| 4,155,600 | A | | 5/1979 | Lanfermann et al. | |
| 4,166,508 | A | | 9/1979 | van den Berg | |
| 4,180,047 | A | | 12/1979 | Bertelson | |
| 4,195,698 | A | | 4/1980 | Nakagawasai | |
| 4,248,550 | A | * | 2/1981 | Blaschke | 294/113 X |
| 4,428,699 | A | | 1/1984 | Juhola | |
| 4,455,105 | A | | 6/1984 | Juhola | |
| 4,505,614 | A | * | 3/1985 | Anschutz | 294/113 X |
| 4,537,527 | A | | 8/1985 | Juhola et al. | |
| 4,553,443 | A | | 11/1985 | Rossfelder et al. | |
| 4,601,615 | A | | 7/1986 | Cavalli | |
| 4,627,768 | A | | 12/1986 | Thomas et al. | |
| 4,735,270 | A | | 4/1988 | Fenyvesi | |
| 4,755,080 | A | | 7/1988 | Cortlever et al. | |
| 4,813,814 | A | | 3/1989 | Shibuta et al. | |
| 4,863,312 | A | | 9/1989 | Cavalli | |
| 5,117,925 | A | | 6/1992 | White | |
| 5,213,449 | A | | 5/1993 | Morris | |
| 5,263,544 | A | | 11/1993 | White | |
| 5,281,775 | A | | 1/1994 | Gremillion | |
| 5,355,964 | A | | 10/1994 | White | |
| 5,375,897 | A | * | 12/1994 | Anthoine | 294/113 X |
| 5,439,326 | A | | 8/1995 | Goughnour et al. | |
| 5,544,979 | A | | 8/1996 | White | |
| 5,609,380 | A | * | 3/1997 | White | 294/104 |
| 5,658,091 | A | | 8/1997 | Goughnour et al. | |

OTHER PUBLICATIONS

A report identifying systems for driving mandrels carrying wick drain material into the earth, identified by Ref. Nos. APE0510 through APE0536 (Undated).

Korean language document identified by Ref. Nos. APE00864 throught APE00891 (from 1982 to 1997).

ICE brochure (Exhibit A) disclosing pile clamps Model 50 and Model 75 universal clamp.

Model 75 universal clamp assembly (Exhibit B).

Model 50 pile clamp assembly operational details. (Exh C).

* cited by examiner

PILE CLAMP SYSTEMS AND METHODS

RELATED APPLICATIONS

This application claims priority of U.S. Provisional Patent Application Ser. No. 60/125,930, which was filed on Mar. 23, 1999.

TECHNICAL FIELD

The present invention relates to clamps that allow vibratory devices to be attached to elongate members and, more particularly, such clamps that are adapted to grip generally cylindrically-shaped piles of wood and/or concrete.

BACKGROUND OF THE INVENTION

In the construction industry, it is often necessary to insert piles into and withdraw piles from the earth. A common scenario is the removal of wooden piles and the replacement of these wooden piles with concrete piles.

To insert piles into and remove piles from the earth, a large driving or pulling force must be applied to the pile. Often, vibratory devices are employed to introduce a vibratory force along the axis of the pile during the process of driving or pulling the pile. The combination of a static pulling or driving force with a vibratory or dynamic force is usually sufficient to overcome the earth's resistance and allow the pile to be inserted or withdrawn.

In cases where the pile is being withdrawn from the earth and/or a vibratory force is being applied, a clamping assembly must be provided to allow a pulling force and/or vibratory forces to be effectively transmitted to the pile. Such clamping devices have heretofore comprised a housing that is attached to a vibratory hammer which in turn is suspended from a crane line and/or vibratory device, a first gripping surface securely attached to the housing, a second gripping surface connected to a pivot arm that is rotatably attached to the housing, and a piston actuator that acts on the pivot arm to force the second gripping surface against the first gripping surface.

Accordingly, to connect a pile to a vibratory device or tensioning cable, the piston actuator is retracted to create a gap between the first and second gripping surfaces. The pile is then inserted between the first and second gripping surfaces and the piston actuator extended such that the pile is gripped between the first and second gripping surfaces. The pile is thus fixed relative to the housing, and the housing itself can be attached to the vibratory device or tensioning cable.

Users have experienced a variety of problems with such prior art clamping assemblies. For example, because piles, especially wooden piles, are often of irregular shapes and sizes, the gripping surfaces do not engage certain of these piles in a manner that effectively transmits tensioning or vibratory loads thereto. This allows the pile to slip within the clamping assembly. This is especially true when the piles are coated with barnacles or other materials that reduce friction between the gripping surfaces and the pile.

Slippage of the pile relative to the clamping assembly lessens the effectiveness of the clamping assembly at transmitting loads to the pile. Further, during insertion of the pile, such slippage can result in the pile moving upward relative to the clamping assembly housing and contacting an upper wall of this housing. Then, as further driving and/or vibratory forces are applied to the pile, the pile batters the upper wall of the housing. This can cause damage to the clamping assembly housing itself, to the assembly by which the housing is attached to the vibratory device or tensioning cable, and to the machined surfaces on the vibratory device.

Another problem with the prior art clamping assemblies is that bolts used to attach the housing thereof to a vibratory device must be installed from within the housing. This is an awkward and time consuming process and exposes the mounting bolts to the impact of the pile.

Yet another problem with prior art clamping assemblies is that, because different gripping surfaces are required for different types of piles, a different clamping assembly is required for each of the types of piles that will be driven or pulled. This is especially a problem in cases where wooden piles are being removed and replaced with more permanent piles such as concrete or steel. In this situation, the entire clamping assembly must be removed from the vibratory device between the removal of one pile and the insertion of another.

From the following discussion, it will be apparent that these and other problems with prior art clamping assemblies are solved by the present invention.

PRIOR ART

The Applicant is aware of the following clamp assemblies for connecting pulling and vibratory devices to a pile to be inserted or extracted.

International Construction Equipment has for several years sold products identified as a Model 70 Pile Clamp and a Model 50 Pile Clamp. Both of these pile clamps have one fixed jaw and one movable jaw. In the Model 70 Pile Clamp, the actuator and pivot point of the movable jaw are arranged on the same side of the pile. With the Model 50 Pile Clamp, the actuator and pivot point of the movable jaw are arranged on opposite sides of the pile.

The Assignee of the present application is also the assignee of U.S. Pat. No. 5,609,380. The '380 patent discloses a clamp assembly having a fixed jaw and a movable jaw. An actuator is operatively connected to the movable jaw such that extension of the actuator causes the movable jaw to move towards the fixed jaw. In the device described in the '380 patent, the movable jaw is pivotably connected to the housing at a pivot point that is arranged on an opposite side of the pile than the side on which the movable jaw is arranged. This arrangement allows the device to be more compact and allows the center of gravity of the clamp assembly to be more aligned with the longitudinal axis of the pile.

U.S. Pat. No. 3,998,063 discloses a pile driving/pulling system comprising one fixed shoe and one movable shoe for gripping the pile.

U.S. Pat. No. 4,195,698 discloses a driving/pulling system having fixed teeth and movable holding teeth formed on a movable holding teeth member.

U.S. Pat. No. 4,180,047 discloses a pile cutting apparatus and system that comprises gripping clamp means for gripping a pile at locations above and below the cut. Eight of these gripping clamp means are located above the cut line. Each of these upper gripping clamp means comprises a dog with gripping teeth formed thereon. The dogs are rotatably connected to a structural member such that the operation of a hydraulic ram forces the gripping teeth against the pile being cut.

U.S. Pat. No. 4,018,290 discloses a hydraulically driven vibrator for driving and/or extracting sheet piles having a pair of clamping jaws. One of these clamping jaws is fixed, and the other is connected to an actuator and pivotably attached to the vibrator housing. Operation of the actuator causes the movable jaw to move towards the fixed jaw to clamp the sheet pile.

U.S. Pat. No. 4,099,387 to Frederick et al. appears to disclose a clamp for driving sheet piles having one fixed jaw portion and a movable jaw or piston that grips the pile against the fixed jaw portion.

U.S. Pat. No. 3,243,190 discloses a vibratory pile driver having a clamp assembly comprising one fixed and one movable jaw.

U.S. Pat. No. 3,243,190 discloses a vibratory pile-driver having a clamp assembly composing one fixed-and-on movable jaw.

U.S. Pat. No. 4,248,550 discloses a clamping mechanism for extracting piles that uses opposing, movable gripping members connected to the clamp housing. The gripping members are connected to a housing using a parallelogram linkage that causes the gripping members to engage the pile when the housing is lifted and disengage the pile when the housing is dropped.

U.S. Pat. No. 3,828,864 discloses a vibratory pile extractor having first and second jaw members. The jaw members receive the pile, and a piston actuator is operated to force the pile against one of the jaw members.

U.S. Pat. No. 5,263,544 to White discloses a shock absorbing apparatus, or suppressor, for use with vibratory pile drivers/extractors.

European Patent Application No. 89830412.6 discloses a vibratory device for drilling machines comprising a double vice arrangement for clamping the vibratory device to the drilling machine.

OBJECTS OF THE INVENTION

From the foregoing, it should be clear that one primary object of the present invention is to provide improved clamping systems and methods for securely attaching a pile to a vibratory device or the like.

A further object of the invention is to provide a clamp assembly having a favorable combination of the following characteristics:

(a) allows vibratory forces to be applied substantially along the longitudinal axis of the pile being driven/extracted;
(b) reduces slippage of the pile relative to the clamp assembly;
(c) improved pile driving ability;
(d) reduction of damage to clamp assembly, connecting assembly, and vibratory device should slippage of the pile relative to the clamp assembly occur;
(e) easier attachment of the clamp assembly to the vibratory device;
(f) allows a quick and easy change from gripping one pile type to gripping another pile type; and
(g) allows the operator of the pile driving and/or pulling equipment to view the operation of the gripping assembly and the activities of workers on the other side of the pile.

As will become clear from the following detailed discussion, these and other objects are achieved by the pile clamp system of the present invention.

SUMMARY OF THE INVENTION

The present invention is a clamping assembly for use in a pile driving and/or removing system that allows a vibratory device to be securely affixed to a pile. The clamping assembly comprises first and second gripping assemblies arranged on either side of the pile. Each gripping assembly is mounted on a pivot arm assembly such that rotation of the pivot arm assembly relative to a housing of the clamp assembly causes the gripping assemblies to engage the pile. Actuator assemblies are rotatably connected to the housing and the pivot arm assemblies such that extension and retraction of the actuator assemblies cause the gripping assemblies to move between an open configuration and a close configuration.

The gripping assemblies, pivot arm assemblies, and actuator assemblies are substantially the same and arranged on opposing sides of the pile such that a center of gravity of the clamping assembly is aligned with a center of gravity of the pile.

In addition, the movement of the gripping assemblies is coordinated such that these gripping assemblies move between the open and close configurations in synchrony with each other. This may be obtained by synchronizing the action of the actuator assemblies used to move the pivot arm assemblies. Preferably, however, this synchronization is obtained by the use of gear members operatively connected to the gripping assemblies. These gear members extend on either side of the pile and engage each other such that synchronized movement of the gripping assemblies is mechanically obtained. The gear members are also symmetrically arranged about the longitudinal axis of the pile to ensure that the center of gravity of the clamping assembly is substantially aligned with the longitudinal axis of the pile being clamped.

The gear members have teeth formed thereon in first and second sets that are offset from each other such that the angular displacement of the pivot arm assemblies relative to horizontal is always the same. The teeth on the gear members extend through an arc of approximately 75 degrees in a circle centered on the longitudinal axis of pivot pins used to attach the pivot arm assemblies to the housing.

The housing is a rigid structure having an upper wall connected to a mounting plate by a vertical plate and a plurality of bracing plates. The top wall, vertical plate, bracing plates, and mounting plate form an anvil that engages and drives the pile should slippage between the pile and gripping assemblies occur.

The housing is configured such that pivot and hinge pins used to attach the pivot arm assemblies and actuator assemblies to the housing are accessible at all times. In addition, openings are formed in the housing such that actuator pins that connect the actuator assemblies to the pivot arm assemblies are accessible when the gripping assemblies are in their open configuration. Similarly, additional openings are formed in the housing such that actuator pins that connect the actuator assemblies to the pivot arm assemblies are accessible when the gripping assemblies are in their closed configuration. The entire clamping assembly thus may be easily assembled and disassembled for manufacture, repair, and maintenance.

The clamping assembly of the present invention obtains the objects described above as well as other objects as will become apparent from a review of the following detailed description.

DETAILED DESCRIPTION OF THE INVENTION

Figure 1:
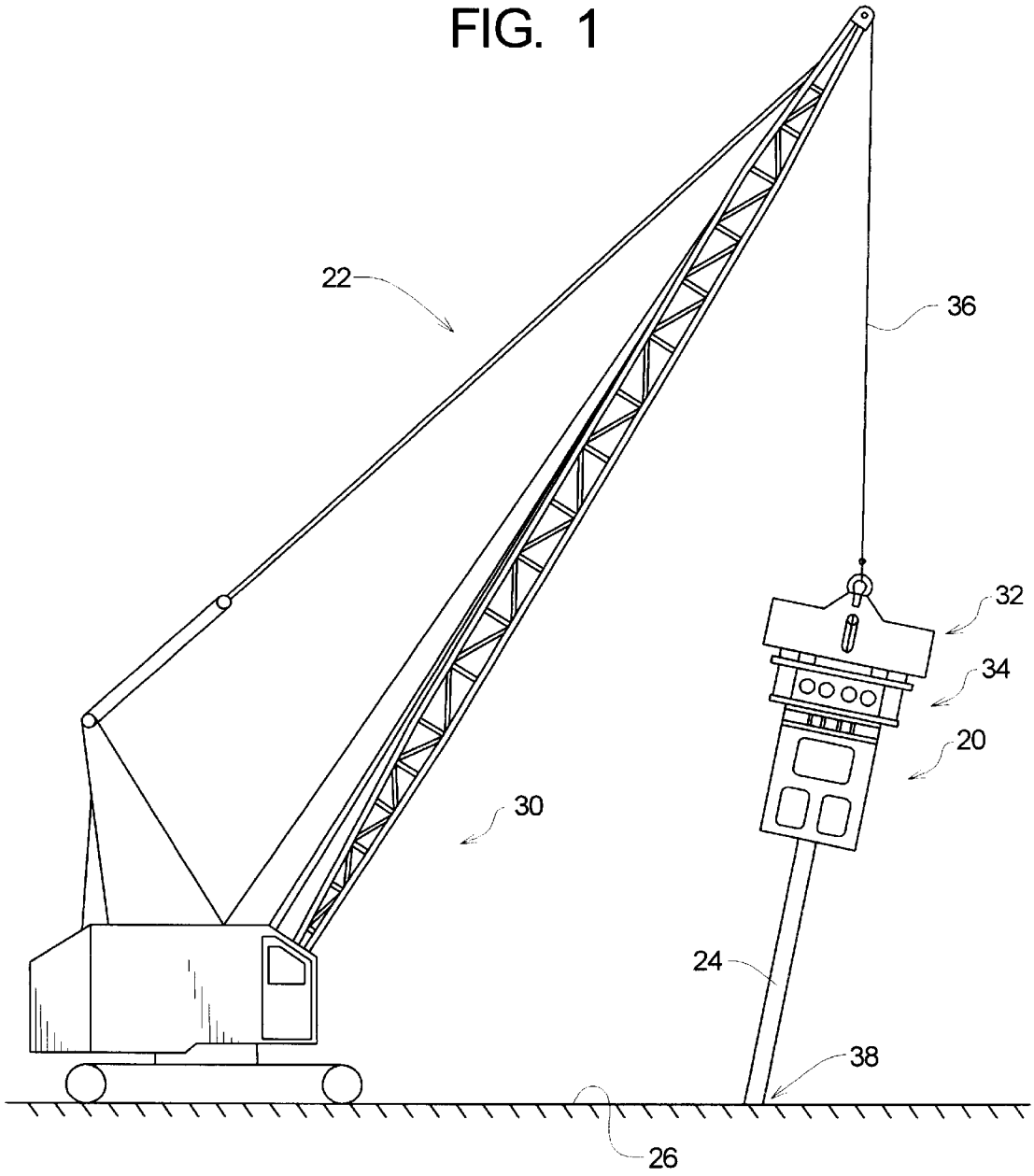
FIG. 1 is a somewhat schematic elevational view depicting a pile driving system employing a clamp assembly constructed in accordance with, and embodying, the principles of the present invention.

Referring initially to FIG. 1, depicted at 20 therein is a clamp assembly constructed in accordance with, and embodying, the principles of the present invention. This clamp assembly 20 is shown being used as part of a pile driving system 22 that is being used to drive a pile 24 into the ground 26. The pile driving system 22 is generally conventional and will not be described in detail herein. This system 22 basically comprises a crane assembly 30, a suppressor assembly 32, and a vibrator assembly 34. The suppressor assembly 32 is connected between a main cable 36 of the crane assembly 30 and the vibrator assembly 34. The vibrator assembly 34 is in turn rigidly connected to the clamp assembly 20. As will be described in detail below, the clamp assembly 20 engages the pile 24 such that the pile 24 is secured to the vibrator assembly 34.

In use, the pile driving system 22 may be used either to drive piles (as shown in FIG. 1) or to extract piles. When driving piles, the main cable 36 supports the clamp assembly 20, pile 24, suppressor assembly 32, and vibrator assembly 34 such that the pile 24 is held at a desired location 38 at a slight angle. Most of the weight of the clamp assembly 20, pile 24, suppressor 32, and vibrator assembly 34 is supported by the pile 24. Accordingly, when the vibrator assembly 34 operates, the combination of the static forces of the weight carried by the pile 24 and the vibratory forces generated by the vibrator assembly 34 will cause the pile 24 to be driven into the ground 26 at the desired location 38. The operator will allow the effective length of the main cable 36 to increase as the pile is driven into the earth 26. The suppressor assembly 32 inhibits transmission of vibratory forces from the vibrator assembly 34 to the main cable 36.

During extraction of a pile, the situation is similar to that shown in FIG. 1. When extracting a pile, however, a relatively large tensioning load is applied to the suppressor assembly 32 through the main cable 36. Accordingly, when the vibratory assembly 34 is operated, the combination of the static tensioning load and the vibratory forces cause the pile to be withdrawn from the earth 26.

The crane assembly 30, suppressor assembly 32, vibratory assembly 34, and main cable 36 are all conventional and will not be described in detail herein.

Figure 2:
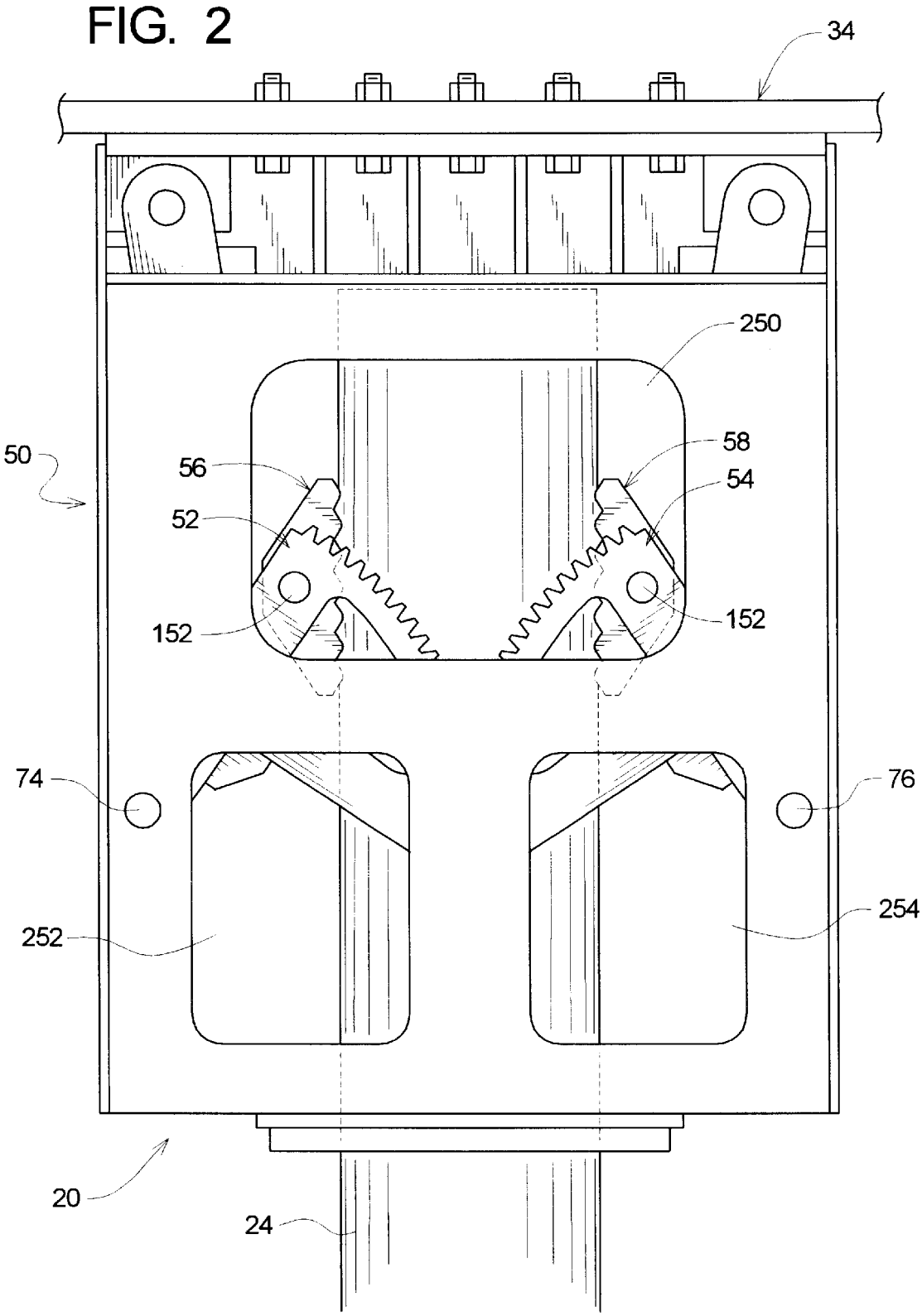
FIG. 2 is a front elevational view showing the clamping assembly in FIG. 1 in more detail when engaged with the pile.
Figure 4:
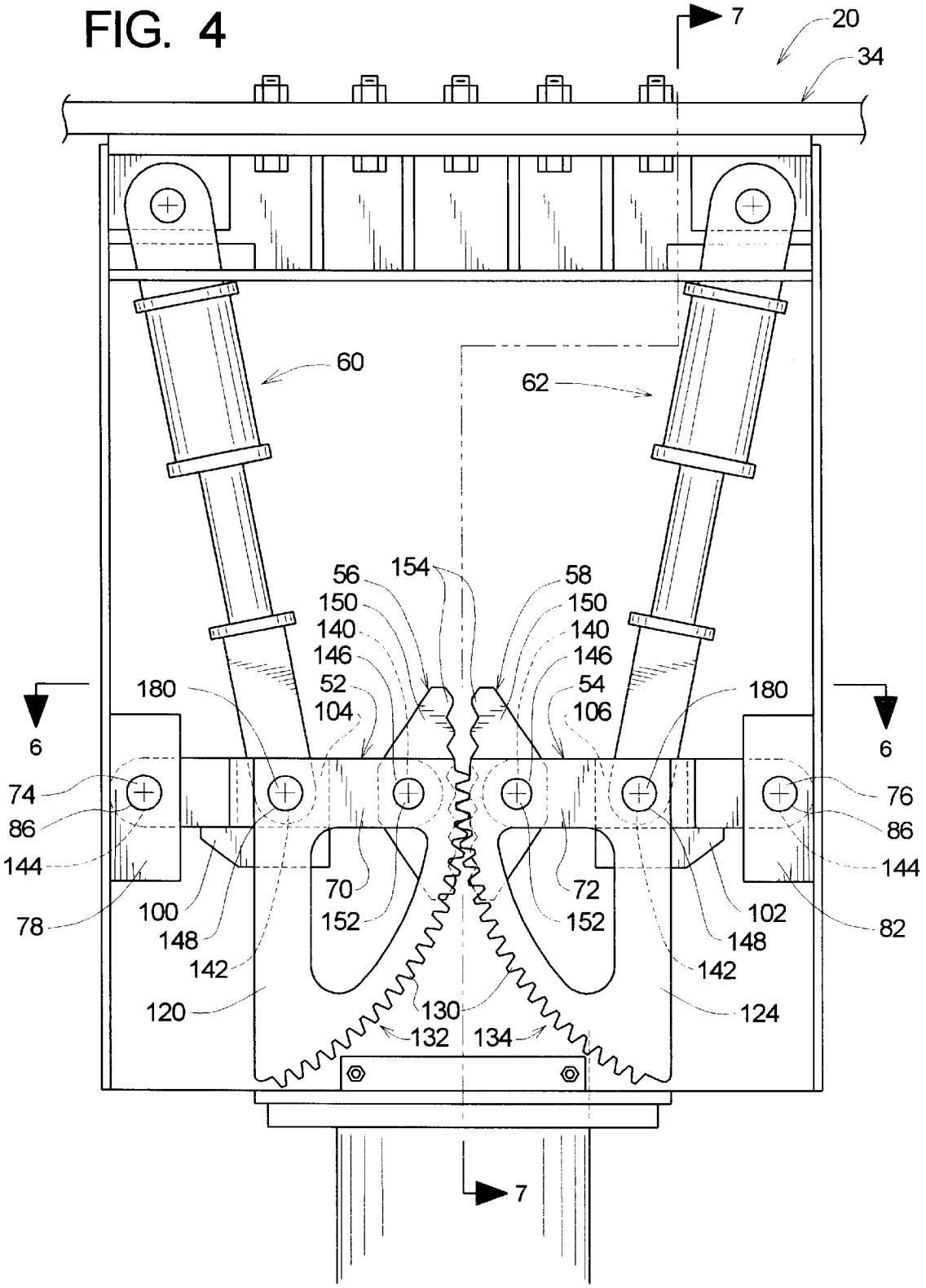
FIG. 4 is a front elevational view of the clamp assembly with a front panel of the clamp housing removed.
Figure 5:
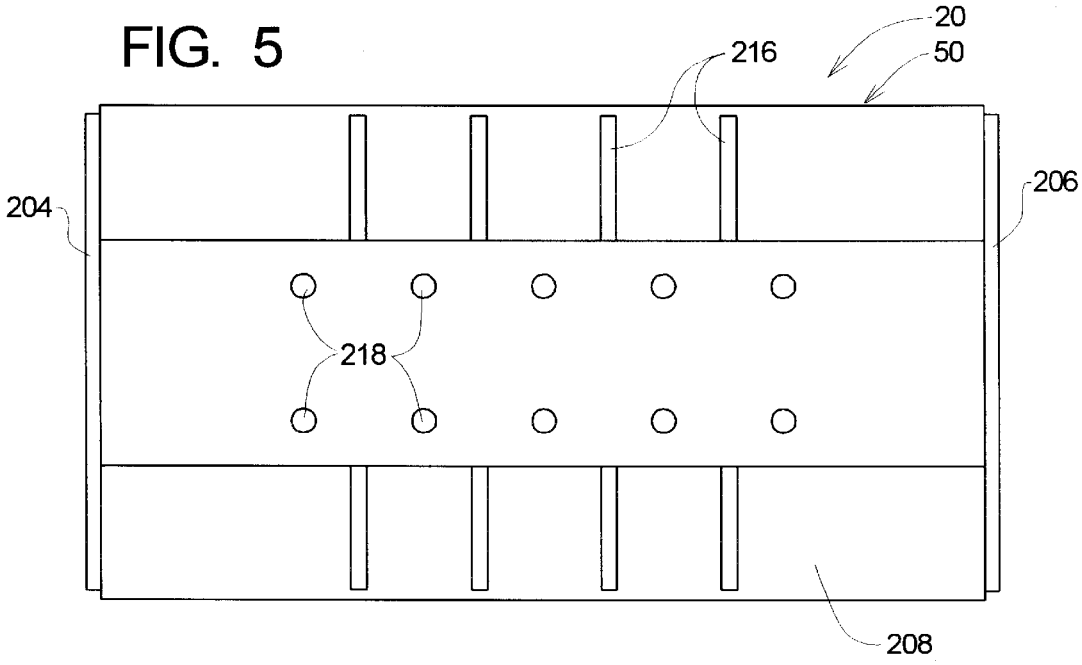
FIG. 5 is a top plan view of the clamp assembly 20.

Referring now to FIG. 2, the clamp assembly 20 will be described in further detail. The clamp assembly 20 comprises a housing 50, first and second pivot assemblies 52 and 54, first and second gripping assemblies 56 and 58, and first and second actuator assemblies 60 and 62 (FIG. 4).

Figure 6:
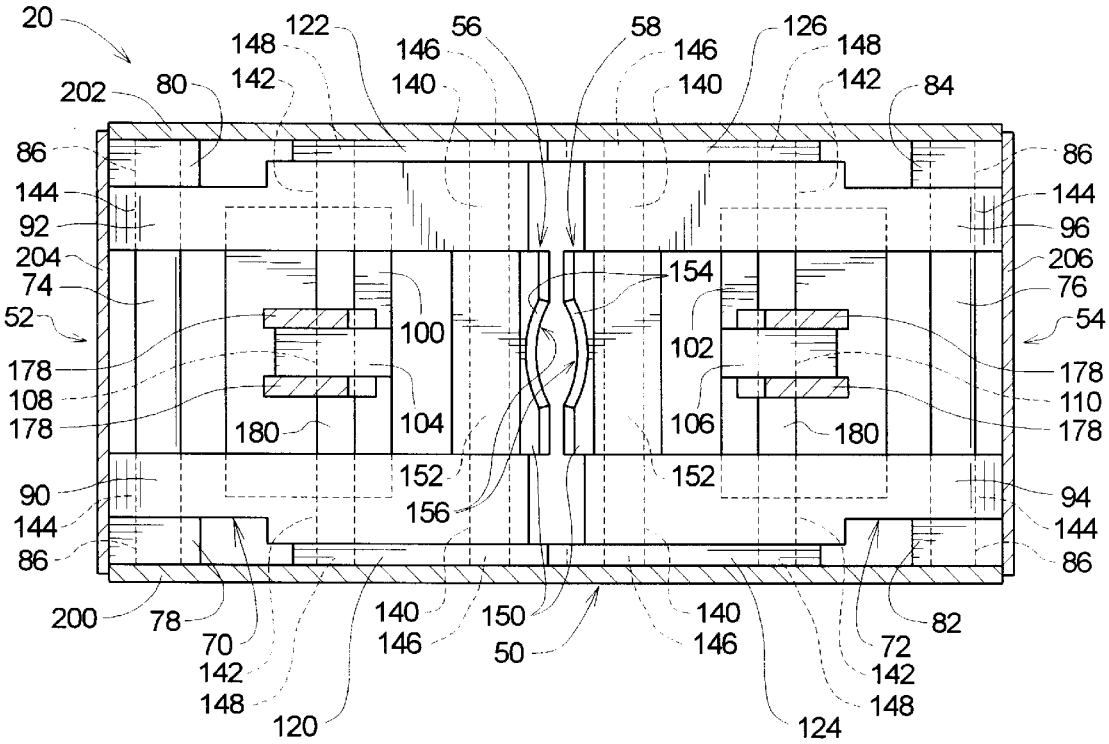
FIG. 6 is a section view taken along lines 6—6 in FIG. 4.

The pivot assemblies 52 and 54 each comprise a pivot arm assembly 70, 72 and a pivot pin 74, 76. The pivot pins 74, 76 rotatably attach the pivot arm assemblies 70, 72 to pivot flanges 78, 80, and 82, 84 (FIGS. 4 and 6). The pivot flanges 78–84 are bearing blocks on which the pivot pins 74, 76 are securely supported relative to the housing 50. Flange holes 86 are formed in the pivot flanges 78–84.

The pivot arm assemblies 70 and 72 comprise arm members 90, 92, and 94, 96. Bridge members 100 and 102 extend between the arm members 90, 92 and 94, 96, respectively. Spacing blocks 104 and 106 are mounted on the bridge members 100 and 102, and spacing holes 108 and 110 are formed in the spacing blocks 104 and 106. Gear members 120, 122 and 124, 126 are attached to the arm members 90, 92, and 94, 96.

While the pivot arm assemblies 70, 72 may be cast as a single part, these are preferably formed by welding the arm members 90–96, bridge members 100 and 102, spacing blocks 104 and 106, and gear members 120–126 together. The main structure of the pivot arm assemblies is formed by the connection of the arm members 90–96 with the bridge members 100 and 102. The spacing blocks allow the actuator assemblies 60 and 62 to be connected to the pivot arm assemblies 70 and 72 as will be described in further detail below. The gear members 120–126 are rigidly connected to the arm members 90–96.

Figure 8:
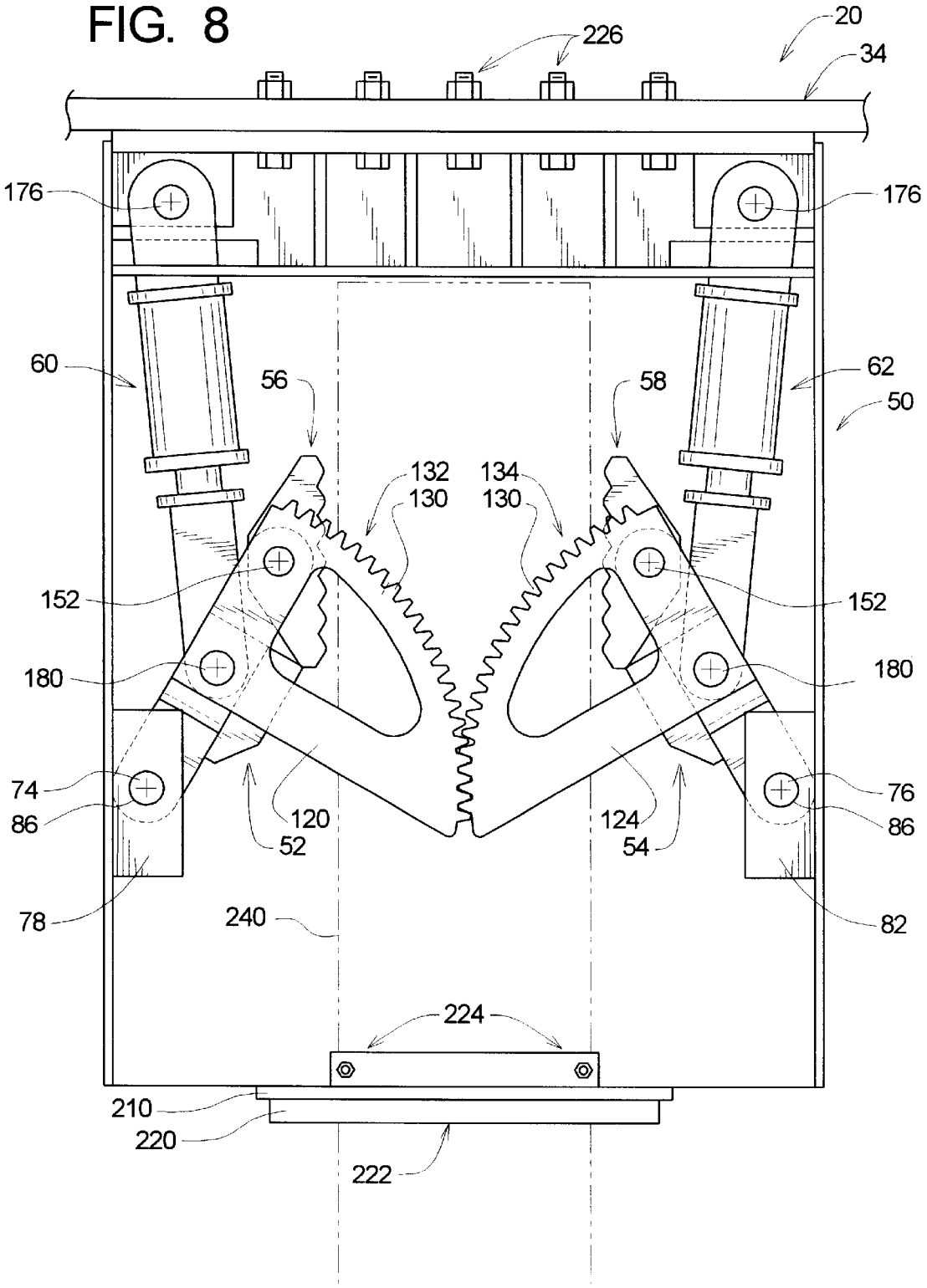
FIG. 8 is a front elevational view similar to that of FIG. 4 depicting the gripping assemblies in an open configuration.

The gear members 120-126 comprise, as perhaps best shown in FIGS. 4 and 8, teeth 130. The teeth 130 on the gear members 120 and 122 are arranged in a first set 132. The teeth 130 on the gear members 124 and 126 are arranged in a second set 134. The teeth 130 are configured and the sets of teeth 132 and 134 are offset from each other such that the teeth 130 engage each other and the arm members 90 and 92 are parallel to the arm members 94 and 96 when the actuator assemblies 60 and 62 are fully extended. By retracting the actuator assemblies 60 and 62 as shown in FIG. 8, the pivot arm assemblies 70 and 72 are moved upward in synchrony with each other such that the inside angles of the arm members 90 and 92 are the same as the inside angles of the arm members 94 and 96 with respect to horizontal.

Referring again to FIGS. 4 and 6, it can be seen that a plurality of holes are formed in the pivot arm assemblies 70 and 72. In particular, a grip hole 140, an actuator hole 142, and a pivot hole 144 are formed in each of the arm members 90–96. A gear grip hole 146 and a gear actuator hole 148 are formed in each of the gear members 120–126. The grip holes 140 are aligned with each other and the gear grip holes 146 along a common axis. Similarly, the actuator holes 142 and the gear actuator, holes 148 are aligned with each other and along a common axis. The pivot pins 74 and 76 extend through the flange holes 86 formed in the pivot flanges 78–84 and the pivot holes 144 formed in the arm members 90–96 such that the pivot arm assemblies 70 and 72 pivot about axes defined by the pivot pins 74 and 76.

Referring for a moment again to the first and second sets 132 and 134 of teeth 130, it can be seen that these sets 132 and 134 lie along circles centered at the axes of the pivot pins 74 and 76. In particular, these sets of teeth 132 and 134 lie in an arc defined by an angle of approximately 75 degrees.

Figure 7:
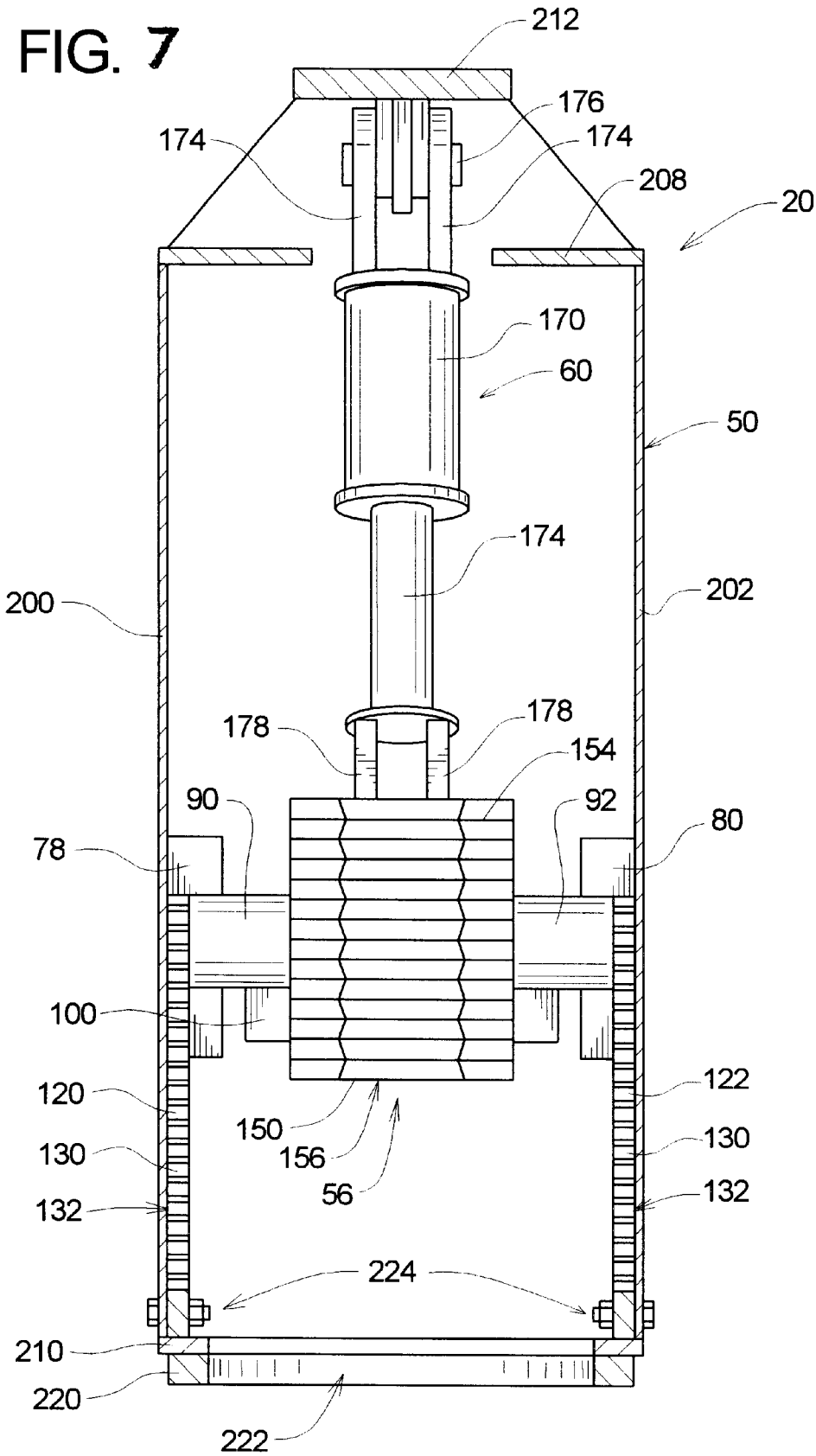
FIG. 7 is a section view taken along lines 7—7 in FIG. 4.

Referring now to FIGS. 6 and 7, depicted therein in detail are the gripping assemblies 56 and 58. These gripping assemblies are identical and each comprises a gripping member 150 and a gripping pin 152. Gripping ribs 154 are formed on the gripping member 150 and a slightly concave gripping surface 156 is defined on the gripping member 150 where this member is intended to engage the pile 24. It should be noted that the gripping surface 156 and the gripping ribs 154 will be designed to accommodate a pile of a given cross-sectional area and material. For example, to drive or remove a wooden pile, the ribs 154 will be relatively sharper and the gripping surface 156 will be curved so that it closely approximates the outer surface of the piles being driven or pulled. For a concrete pile, the ribs will be smaller or perhaps even eliminated to provide greater surface area for engagement with the pile and thus increased friction to reduce slippage.

Referring still to FIG. 7, the actuator assemblies 60 and 62 will now be described in further detail. These assemblies 60 and 62 are identical, and only the actuator assembly 60 will be described in detail with the understanding that this description applies to the other actuator assembly 62.

The actuator assembly 60 comprises an actuator cylinder 170 and an actuator shaft 174. The shaft 174 reciprocates within the cylinder 170 to increase or decrease the effective length of the actuator assembly 60. The cylinder 170 will preferably be a hydraulic cylinder with a piston head attached to the shaft 174 such that introduction of hydraulic fluid on either side of the piston head within the cylinder 170 causes appropriate movement of the shaft 174. Such assemblies are well known and will not be described in detail herein.

Rigidly extending from the cylinder 170 are a pair of hinge flanges 174. A hinge pin 176 extending through the hinge flanges 174 rotatably attaches the actuator assembly 60 to the housing 50. A pair of shaft flanges 178 extend from the shaft 174. An actuator pin 180 extends through the shaft flanges 178 and the spacing holes 108 and 110 in the spacing blocks 104 and 106. The actuator pins 180 thus rotatably attach the actuator assemblies 60 and 62 to the pivot arm assemblies 70 and 72.

The housing 50 will now be described in detail. The housing 50 is a rigid structure that performs two main purposes. First, it allows the clamp assembly 20 to be connected to the vibratory device 34 as described above. Second, it forms a rigid structure that spaces the pivot pins 74 and 76 and hinge pins 176 in a predetermined relationship to one another. In addition, the housing 50 encloses moving parts and is perforated at strategic locations to allow disassembly and maintenance of the moving parts contained therein.

The housing 50 is a hollow, generally rectangular body comprising a front wall 200, a back wall 202, end walls 204 and 206, a top wall 208, and a bottom wall 210. A mounting plate 212 is spaced above the top wall 208 by a vertical plate 214 and a plurality of bracing plates 216. A plurality of mounting holes 218 are formed in the mounting plate 212. The bracing plates 216 are spaced from each other so that access to the mounting holes 218 is unhindered.

Mounted below the bottom wall 210 is an alignment plate 220 in which an alignment opening 222 is formed. The bottom plate 210 and alignment plate 220 are attached to the front and back walls 200 and 202 by bolt assemblies 224.

Bolt assemblies 226 are used to attach the mounting plate 212 to the vibrator assembly 34, only a position of which is shown in FIGS. 2, 4, and 8.

Figure 3:
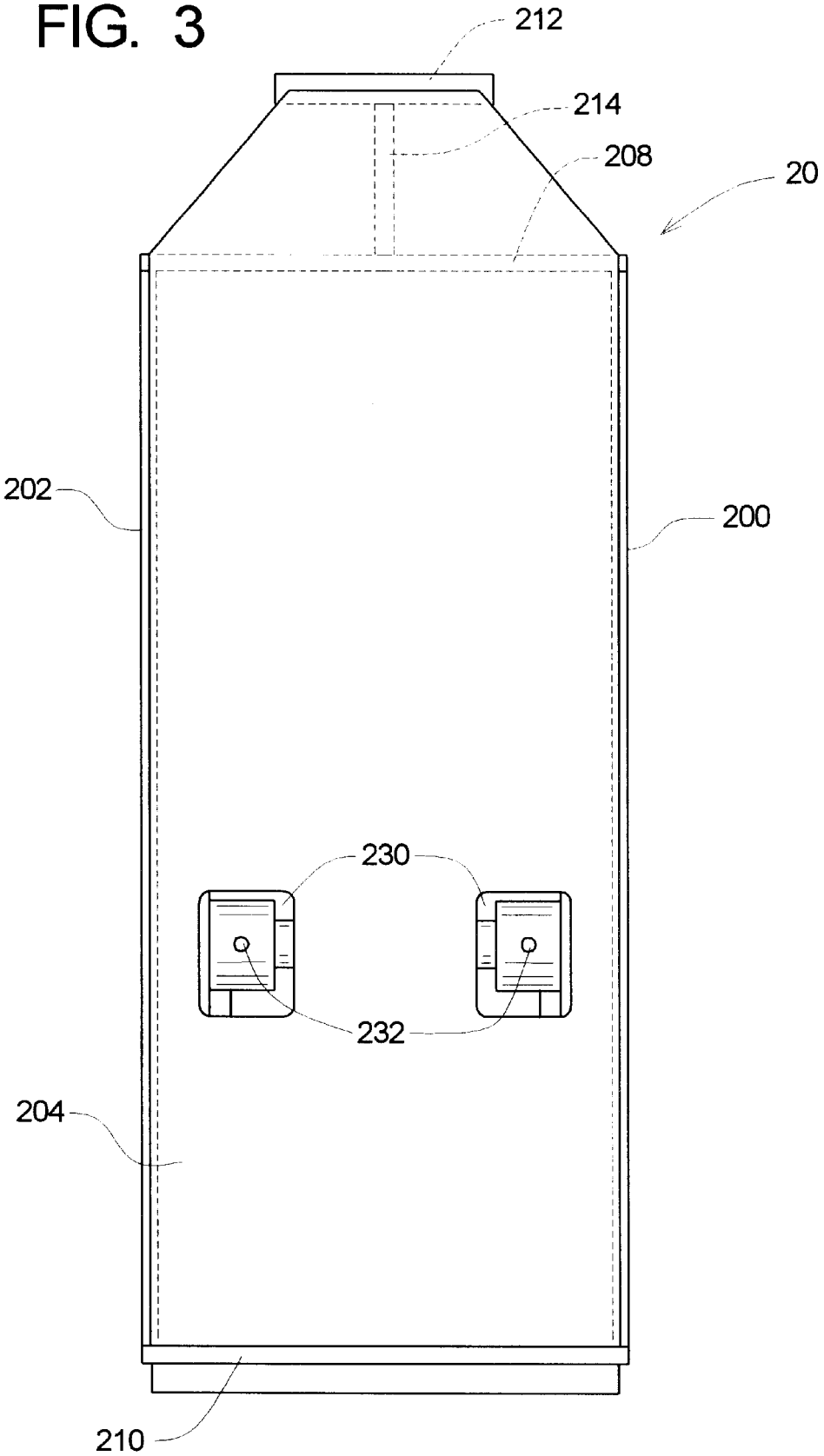
FIG. 3 is a side elevational view depicting access openings formed in the housing of the clamp assembly.

Referring to FIG. 3, access openings 230 are formed in the end walls 204 and 206 to allow access to set screws 232 that fix the pivot pins 74 and 76 relative to the arm members 90, 92, and 94, 96.

As shown in FIG. 8, a pile area 240 is defined within the clamp assembly 20. The clamp assembly 20 is symmetrically arranged about this pile area 240 such that a center of gravity of the clamp assembly 20 extends through the middle of the pile area 240. Accordingly, when the pile 24 is engaged with the clamp assembly 20 as shown in FIG. 2, the longitudinal axis of the pile 24 is substantially aligned with the center of gravity of the clamp assembly 20. Accordingly, when the driving/pulling forces and vibratory forces are applied to the clamp assembly 20, the clamp assembly 20 symmetrically applies these forces to the pile 24 in a manner that does not create a bending moment in the pile 24 under normal conditions.

As described above, the actuator assemblies 60 and 62 extend and retract such that the gripping assemblies 56 and 58 move between a fully open position as shown in FIG. 8 and a fully closed position as shown in FIG. 4. The clamp assemblies 56 and 58 are spaced farthest from each other in the open position and closest to each other in the closed position. To engage a pile, the actuator assemblies 60 and 62 are shortened to place the gripping assemblies 56 and 58 in their open configuration. The pile is then passed through the alignment opening 222 into the pile area 240. The actuators are then extended such that the gripping assemblies 56 and 58 move towards each other until the pile 24 is securely gripped therebetween as shown in FIG. 2.

The gear members 120, 122, and 124, 126 engage each other as the gripping assemblies 56 and 58 move between the open and close configurations so that these gripping assemblies 56 and 58 move in synchrony with each other. This ensures that the longitudinal axis of the pile 24 is as close as possible to the center of gravity of the clamping assembly 20.

In addition, when the pile 24 is clamped as shown in FIG. 2, the gear members 120–126 engage each other to rigidify the entire clamp assembly 20. This will reduce lateral movement or vibration of the housing 50 relative to the pile 24 when vibratory loads are being transmitted through the clamping assembly 20.

The housing 50 is configured with a plurality of access openings including an upper access opening 250 and first and second lower access openings 252 and 254. When the clamping assemblies are in their open configuration as shown in FIG. 8, the gripping pins 152 may be accessed through the upper access opening 250 to allow these pins 152 to be removed and inserted to facilitate changing of the gripping assemblies 56 and 58. When the gripping assemblies 56 and 58 are in their closed position as shown in FIG. 4, the actuator pins 180 may be accessed through the lower access openings 252 and 254. This facilitates disassembly of the pivot arm assembly 70 and 72 from the actuator assemblies 60 and 62 for repair and maintenance.

And as shown in FIG. 2, the pivot pins 74 and 76 and hinge pins 176 are accessible from outside of the housing 50 to facilitate removal of these pins 74, 76, and 176 for repair and maintenance of the clamping assembly 20.

From the foregoing, it should be apparent that the present invention may be embodied in forms other than that described above. The scope of the invention should thus be determined by the claims appended hereto and not the foregoing detailed description.

What is claimed is:

1. A clamp assembly for attaching a pile defining a longitudinal axis to a pile driving apparatus for inserting and/or extracting the pile, comprising:

a housing;

a first pivot assembly pivotably attached to the housing;

a first gripping assembly rotatably attached to the first pivot assembly;

a second pivot assembly pivotably attached to the housing;

a second gripping assembly rotatably attached to the second pivot assembly;

a first actuating assembly for displacing the first pivot assembly and the first gripping assembly such that the first gripping assembly moves towards the second gripping assembly; and a second actuating assembly for displacing the second pivot assembly and the second gripping assembly such that the second gripping assembly moves towards the first gripping assembly; wherein the first and second actuating assemblies move the first and second gripping assemblies towards each other such that the pile is gripped between the first and second gripping assemblies to inhibit axial and radial movement of the pile relative to the housing, and a center of gravity of the clamp assembly is substantially aligned with the longitudinal axis of the pile.

2. A clamp assembly as recited in claim 1, further comprising a synchronizing assembly for synchronizing movement of the first and second gripping assemblies towards each other such that the center of gravity of the clamp assembly is substantially aligned with the longitudinal axis of the pile.

3. A clamp assembly as recited in claim 2, in which the synchronizing assembly comprises:

a first engaging projection formed on the first pivot assembly; and a second engaging projection formed on the second pivot assembly;

wherein when the first and second gripping assemblies move toward each other, the first and second engaging projections engage each other to synchronize the movement of the first and second gripping assemblies.

4. A clamp assembly as recited in claim 3, in which the first and second engaging projections each comprises at least one gear member, where the gear members engage each other as the first and second gripping assemblies move towards each other.

5. A clamp assembly as recited in claim 4, in which the first and second engaging projections each comprises a pair of gear members, where the gear members straddle the pile and each of the gear members of the first pivot assembly engages one of the gear members of the second pivot assembly.

6. A method of attaching a pile defining a longitudinal axis to a pile driving apparatus with a clamp assembly and/or extracting the pile, comprising the steps of:

providing a housing;

pivotably attaching a first pivot assembly to the housing;

rotatably attaching a first gripping assembly to the first pivot assembly;

pivotably attaching a second pivot assembly to the housing;

rotatably attaching a second gripping assembly to the second pivot assembly;

displacing the first pivot assembly and the first gripping assembly such that the first gripping assembly moves towards the second gripping assembly;

displacing the second pivot assembly and the second gripping assembly such that the second gripping assembly moves towards the first gripping assembly; and synchronizing movement of the first and second gripping assemblies such that the pile is gripped between the first and second gripping assemblies to inhibit axial and radial movement of the pile relative to the housing, and a center of gravity of the clamp assembly is substantially aligned with the longitudinal axis of the pile.

7. A method as recited in claim 6, further comprising the step of synchronizing movement of the first and second gripping assemblies towards each other such that the center of gravity of the clamp assembly is substantially aligned with the longitudinal axis of the pile.

8. A method as recited in claim 7, further comprising the steps of:

forming a first engaging projection on the first pivot assembly;

forming a second engaging projection on the second pivot assembly; and engaging the first and second engaging projections to synchronize the movement of the first and second gripping assemblies when the first and second gripping assemblies move toward each other.

9. A method as recited in claim 8, in which the first and second engaging projections each comprises at least one gear member, further comprising the step of engaging the gear members as the first and second gripping assemblies move towards each other.

10. A method as recited in claim 9, in which the first and second engaging projections each comprises a pair of gear members, further comprising the step of arranging the gear members such that the gear members straddle the pile and each of the gear members of the first pivot assembly engages one of the gear members of the second pivot assembly.

* * * * *